United States Patent [19]

Kerr et al.

[11] Patent Number: 4,915,859

[45] Date of Patent: Apr. 10, 1990

[54] MICRO-EMULSION DRAWING FLUIDS FOR STEEL AND ALUMINUM

[75] Inventors: E. Michael Kerr, Naperville; Bernard R. Szyszko, Warrenville, both of Ill.

[73] Assignee: Nalco Chemical Company, Naperville, Ill.

[21] Appl. No.: 245,106

[22] Filed: Sep. 16, 1988

[51] Int. Cl.[4] ..... C10M 173/00

[52] U.S. Cl. ..... 252/49.5; 252/52 A; 72/42

[58] Field of Search ..... 252/49.5; 72/42

[56] References Cited

U.S. PATENT DOCUMENTS

| | | | |
|---|---|---|---|
| Re. 28,474 | 7/1974 | Anderson et al. | 260/29.6 H |
| Re. 28,576 | 10/1975 | Anderson et al. | 260/29.6 H |
| 3,071,544 | 1/1963 | Rue | 252/49.5 |
| 3,105,050 | 9/1963 | Fischer | 252/49.5 |
| 3,252,907 | 5/1966 | Kharouf et al. | 252/49.5 |
| 3,268,447 | 8/1966 | Dickey et al. | 252/49.5 |
| 3,501,404 | 3/1980 | Klaiber et al. | 252/49.5 |
| 3,507,792 | 4/1970 | Zuraw | 252/49.5 |
| 3,624,019 | 11/1971 | Anderson et al. | 260/29.6 H |
| 3,634,245 | 1/1972 | Meisters | 252/49.3 |
| 3,734,873 | 5/1973 | Anderson et al. | 260/29.6 H |
| 3,767,629 | 10/1973 | Vallino, Jr. et al. | 260/80.3 N |
| 3,791,974 | 2/1974 | Borchert | 252/49.5 |
| 3,826,771 | 7/1974 | Anderson et al. | 260/29.6 H |
| 3,915,920 | 10/1975 | Slovinsky et al. | 260/29.6 R W |
| 3,996,180 | 12/1976 | Kane | 260/29.6 H |
| 3,997,492 | 12/1976 | Kane et al. | 260/29.6 WQ |
| 4,024,097 | 5/1977 | Slovinsky et al. | 260/29.6 N |
| 4,111,820 | 9/1978 | Conti | 252/49.5 |
| 4,371,447 | 2/1983 | Webb et al. | 252/49.5 |
| 4,440,654 | 4/1984 | Zimzik | 252/49.5 |
| 4,452,711 | 6/1984 | Laemmle | 252/49.3 |
| 4,466,909 | 8/1984 | Stayner | 252/49.5 |
| 4,481,125 | 11/1984 | Holgado | 252/49.5 |
| 4,585,564 | 4/1986 | Tohmata et al. | 252/49.5 |
| 4,654,155 | 3/1987 | Kipp et al. | 252/49.5 |

*Primary Examiner*—William R. Dixon, Jr.
*Assistant Examiner*—E. M. McAvoy
*Attorney, Agent, or Firm*—Anthony L. Cupoli; John S. Roberts, Jr.; Donald G. Epple

[57] ABSTRACT

A drawing and stamping extreme pressure lubricant for steel and aluminum which comprises a water-in-oil micro-emulsion which consists essentially of about 2 to 30 percent of a 500 to 3,000 s.u.s. hydrocarbon oil and suitable emulsifiers and stabilizers used as the base for the emulsion including tall oil fatty acids, triethanolamine soaps, petroleum sulfonates, and non-ionic emulsifiers. By substituting an ethoxylated vegetable oil, such as caster oil, etc., for the hydrocarbon oil in the above formulation, a second extreme pressure lubricant is arrived at. Thus, this lubricant consists of 2 to 30 percent of an oxidized vegetable oil polymer where the oxidized portion is 4 to 30 moles selected from a group consisting of ethylene oxide (EO), propylene oxide (PO), and ethylene/propylene oxide (EO/PO) units of vegetable oil.

12 Claims, No Drawings

MICRO-EMULSION DRAWING FLUIDS FOR STEEL AND ALUMINUM

BACKGROUND OF THE INVENTION

The present invention describes improved drawing compounds useful for steel and aluminum or other like metals. In a drawing or stamping operation, a great deal of heat is produced at the boundary interface between the draw and the drawing apparatus. To reduce the effects of heat, liquid compositions have been utilized at the interface. In the past, water based chemistry has been utilized and hydrocarbon oils based chemistry has been utilized. In this invention, high-viscosity hydrocarbon oils in the form of a micro-emulsion are used. Such a micro-emulsion contains about 2 to 30 percent of 500 to 3,000 s.u.s. hydrocarbon oils and a base of emulsifiers and stabilizers. The drawing fluid produced by this invention is a micro-emulsion wherein the colloidal particles are one micron or below. These micro-emulsions are emulsions containing particles as aforesaid which are limited to one micron or $10^6$ for at least one particle dimension. These micro-emulsions may be produced by acid hydrolysis and agitation. In this particular invention, the emulsions are produced in the form of water-in-oil emulsions which, upon contact with excess water, invert and become oil-in-water emulsions. The micro-emulsion particles are characterized by enlarged surface area-to-volume relationship and they do not settle out and are small enough to sift out through filter membranes. These micro-emulsions show good coefficients of friction indicating high values for lubricity and have good coolant qualities when utilized in drawing operations. They are also known as semi-synthetic drawing fluids where water is incorporated and utilized as a portion of the emulsion as in the straight oil usually used.

In a second portion of the invention, the high-viscosity hydrocarbon oils are exchanged with ethoxylated vegetable oils, for example, ethoxylated castor oil. Other oxides, such as ethylene oxide, propylene oxide and ethylene oxide/propylene oxide copolymers may be utilized. It has been found that about 4 to 30 moles of the ethylene oxide and related compounds may be utilized as the oxidized fraction of the vegetable oil and in the repeating units. In this portion of the invention, the semi-synthetic of the micro-emulsion oils is changed to interchanging the high-viscosity hydrocarbon oil with an ethoxylated vegetable oil, such as castor oil, producing a synthetic.

The vegetable oils which are triacetyl glycerides may be selected from a variety of vegetable oils, such as corn, cottonseed, palm, peanut, soybean and olive. The vegetable oils also are known as fats in other descriptions and they are derived from fatty acids of $C_3$ to $C_{24}$ carbon atoms and all are from even-numbered carbon atoms, except $C_3$ and $C_5$ derivatives. A preferred range of carbon atoms in from $C_{12}$ to $C_{24}$. The lubricant base for these vegetable oils in the micro-emulsion is similar to that for the natural hydrocarbon oils and may be emulsifiers and stabilizers selected from tall oil fatty acids and triethanol amine soaps, petroleum sulfonates and non-ionic emulsifiers.

In addition to an ethoxylate vegetable oil or hydrocarbon oil, the water-in-oil emulsion may contain under the heading of stabilizer, water-in-oil surfactants and like, and material such as triethanolamine, EO/PO tall oil acid ester, sodium petroleum sulfonate (5–15% of the micro-emulsion) and a $C_{12}$–$C_{24}$ fatty acid amine soap, a non-ionic alkoxylated coupling agent (3–7% of the micro-emulsion), and a low degree alkoxylated vegetable oil (0–10% by weight of the micro-emulsion).

In the above, lubricants resulting from the two branches of the invention are described, namely, the natural hydrocarbon oils, on the one hand, and the vegetable oils, on the other hand, utilizing drawing and stamping compositions. Since the preparation of similar micro-emulsions is well known in the art and may proceed from several methods, further teaching of this process will not be necessary. The particular method utilized here is to prepare the water-in-oil emulsion under processes similar to that of Anderson and Frisque, (Nalco Chemical Company), see Example 2, and then invert with the addition of water to produce the final usable oil-in-water emulsion. Also, there have been described the compositions and the area of use, but a description of the draw and the metal-working apparatus is believed to be unnecessary, since it is well known and has been used many times before. It is to be noted that all of these compositions avoid the use of chlorine which has been found to be corrosion correlating as a gas or liquid.

A specific formulation for a composition involving oxidized castor oil is set out below.

4.5% ethoxylated (5–6 moles) carboxy-4-hexyl-2-cyclohexene octanoic acid (caster oil);
6.3% tall oil;
2.7% triethanolamine;
1.8% EO/PO tall oil acid ester;
9.0% sodium petroleum sulfonate;
2.7% EO/PO polymer;
18.0% caster oil ethoxylate (25 moles);
50.35% D.I. water;
4.5% polyglycol, alkanol amine mixture;
0.15% triazine.

In other examples the percent of caster oil ethoxylate was varied to 2 to 30 percent. Cottonseed and soy bean oil were utilized as examples in similar percentages, by specific percentages of 2, 4.5 and 20 percent s.u.s. hc. were used. In addition, where the active ingredient was 500 to 3,000 s.u.s. hydrocarbon oil, similiar examples were used with 2, 4.5 and 20 percent hc. oils of 500, 1000 and 2000 s.u.s. The emulsifiers and stabilizers were varied according to the teaching further in this invention, describing water-in-oil type emulsifiers.

It has been stated above that the oils, water and emulsions generally have been described in the prior art.

Additional prior art in this area is listed below:

U.S. Pat. No. 3,501,404 to Klieber et al, Union Carbide, which discloses an aqueous emulsion containing an emulsifier and polymer in the range of 1,500 to 25,000 s.u.s. and the polymer being present in 0.1 to 25 percent of the emulsion;

U.S. Pat. No. 3,634,245 to Meisters, Kerns United Corp., which discloses a water-soluble lubricant product obtained by transesterifying a triglyceride, for example, caster oil, with a polymeric alkylene oxide glycol and then esterifying the hydroxy compounds present with a dicarboxylic acid;

U.S. Pat. No. 4,111,820 to Conti, which relates to drawing wire through a die, etc., and utilizes polyethylene oxide and a dispersant which may be polypropylene/glycol as a die lubricant;

U.S. Pat. No. 4,452,711 to Laemmle, describes an aqueous metal-working lubricant comprising a water-soluble mix of polyoxypropylene, polyoxyethylene, polyoxyethylene/propylene block copolymers, a water-soluble carboxylic acid, a water-soluble alkanol amine and water used for cold-rolling and hot-rolling a metal such as aluminum and aluminum alloys.

It is believed that the present invention here differs from the prior art and contains elements which are new and useful.

It is also possible to further characterize the water-in-oil emulsions of water-soluble vinyl addition polymers with respect to the aqueous phase of the emulsions. This aqueous phase is generally defined as the sum of the polymer or copolymer present in the emulsion plus the amount of water present in the emulsion. This terminology may also be utilized in describing the water-in-oil emulsions which are useful in this invention. Utilizing this terminology, the aqueous phase of the water-in-oil emulsions of this invention generally consists of 25–95% by weight of the emulsion. Preferably, the aqueous phase is between 60–90% and most preferably from 65–85% by weight of the emulsion.

The emulsions also may be characterized in relation to the water/oil ratios. This figure is simply a ratio of the amount of water present in the emulsion divided by the amount of hydrophobic liquid present in the emulsion. Generally, the water-in-oil ratio is 0.25 to 18. Preferably, the water-in-oil ratio will range from 0.3–14, and most preferably from 1.0–2.75.

THE HYDROPHOBIC LIQUIDS

The hydrophobic liquids or oils used in preparing these emulsions may be selected from a large group of organic liquids which include liquid hydrocarbons and substituted liquid hydrocarbons.

A preferred group of organic liquids that can be utilized in the practice of this invention are paraffinic hydrocarbon oils. Examples of these types of materials include a branch-chain isoparaffinic solvent sold by Humble Oil and Refinery Company under the tradename "Isopar M" described in U.S. Pat. No. 3,624,019 and a paraffinic solvent sold by the Exxon Company, U.S.A. called "Low Odor Paraffinic Solvent." Typical specifications of this material are set forth below in Table 1.

TABLE 1

| | |
|---|---|
| Specific Gravity 60°/60° F. | 0.780–0.806 |
| Color, Saybolt | + 30 min. |
| Appearance, visual | Bright and Clear |
| Aniline Point, °F., ASTM D-611 | 160 min. |
| Distillation, °F., ASTM D-86 | |
| IBP | 365 min. |
| FBP | 505 max. |
| Flash Point, °F., TCC | 140 min. |
| Sulfur, ppm, Microcoulometer | 15 max. |

While paraffinic oils are preferred materials for use in preparing the water-in-oil emulsions of this invention, other organic liquids can be utilized. Thus, mineral oils, kerosenes, naphthas, and in certain instances petroleum may be used. While useful in this invention, solvents such as benzene, xylene, toluene, and other water immiscible hydrocarbons having low flash points or toxic properties are generally avoided due to problems associated with their handling.

THE WATER-IN-OIL EMULSIFYING AGENTS

Any conventional water-in-oil emulsifying agent can be used such as sorbitan monostearate, sorbitan monooleate, and the socalled low HLB materials which are all documented in the literature and are summarized in the Atlas HLB Surfactants Selector. Although the mentioned emulsifiers are used in producing good water-in-oil emulsions, other surfactants may be used as long as they are capable of producing these emulsions. It is also contemplated, however, that other water-in-oil emulsifying agents can be utilized.

U.S. Pat. No. 3,997,492 shows the use of emulsifiers generally having higher HLB values to produce stable emulsions similar in character to those discussed above. With the use of the equations present in this reference, which are hereinafter incorporated by reference, emulsifiers having HLB values between 4–9 can be utilized in the practice of this invention.

In addition to the reference described above, U.S. Pat. No. 4,024,097 discloses particular emulsifying agents for the water-in-oil emulsions, which are the subject of this invention. The emulsions are generally prepared according to this reference utilizing the water-in-oil emulsifying agent comprising a partially esterified N,N,-dialkanol substituted fatty amide. Additionally, other surfactants may be combined to produce emulsions having small particle sizes and excellent storage stability.

THE PREPARATION OFTHE WATER-IN-OIL EMULSIONS OF WATER SOLUBLE VINYL ADDITION POLYMERS

The general method for the preparation of emulsions of the type described above is contained in Vanderhoff, U.S. Pat. No. 3,284,393, which is hereinafter incorporated by reference. A typical procedure for preparing water-in-oil emulsions of this type includes preparing an aqueous solution of a water soluble vinyl addition monomer and adding this solution to one of the hydrocarbon oils described above. With the addition of a suitable water-in-oil emulsifying agent and under agitation, the emulsion is then subjected to free radical polymerization conditions and a water-in-oil emulsion of the water soluble vinyl addition polymer is obtained. It should be pointed out that the ingredients are chosen based upon the weight percentages given above and their compatability with each other. As to choice of free radical catalyst, these materials may be either oil or water soluble and may be from the group consisting of organic peroxides, Vazo type materials, redox type initiator systems, etc. Additionally, ultraviolet light, microwaves, etc. will also cause the polymerization of water-in-oil emulsions of this type.

In the manufacture of emulsions of this type, which are further detailed in U.S. Pat. Nos. 3,624,019, Re. 28,474, 3,734,873, Re. 28,576, 3,826,771, all of which are hereinafter incorporated by reference, the use of air may be employed to control polymerization. This technique is described in U.S. Pat. No. 3,767,629 which is also hereinafter incorporated by reference.

In addition to the above references, U.S. Pat. No. 3,996,180 describes the preparation of water-in-oil emulsions of the types utilized in this invention by first forming an emulsion containing small particle size droplets between the oil, water, monomer and water-in-oil emulsifying agent utilizing a high shear mixing technique followed by subjecting this emulsion to free radical polymerization conditions. Also of interest in U.S. Pat. No. 4,024,097 which describes water-in-oil emulsions such as those described above utilizing particular surfactant systems for the water-in-oil emulsifying agent, allowing for the preparation of latexes having small polymer particle sizes and improved storage stability.

Another reference, U.S. Pat. No. 3,915,920, discloses stabilizing water-in-oil emulsions of the type above described utilizing various oil-soluble polymers such as polyisobutylene. Employment of techniques of this type provides for superior stabilized emulsions.

Of still further interest is U.S. Pat. No. 3,997,492 which describes the formation of water-in-oil emulsions of the type above described utilizing emulsifiers having HLB values of between 4–9.

PHYSICAL PROPERTIES OF THE WATER-IN-OIL EMULSIONS

The water-in-oil emulsions of the finely divided water-soluble polymers useful in this invention contain relatively large amounts of polymer. The polymers dispersed in the emulsion are quite stable when the particle size of the polymer is from the range of about 0.2 microns to about 3 microns.

The emulsions prepared having the above composition generally gave a viscosity in the range of from 50 to 1000 cps. It will be seen, however, that the viscosity of these emulsions can be affected greatly by increasing or decreasing the polymer content, oil content, or water content as well as the choice of a suitable water-in-oil emulsifier.

Another factor attributing to the viscosity of these types of emulsions is the particle size of the polymer which is dispersed in the discontinuous aqueous phase. Generally, the smaller the particle size the less viscous the emulsion. At any rate, it will be readily apparent to those skilled in the art as to how the viscosity of these types of materials can be altered. It will be seen that it is important in this invention that the emulsion be somewhat fluid; i.e., pumpable.

THE INVERSION OF THE WATER-IN-OIL EMULSIONS OF THE WATER SOLUBLE VINYL ADDITION POLYMERS

The water-in-oil emulsions of the water-soluble polymers discussed above have unique ability to rapidly invert when added to aqueous solution in the presence of an inverting agent or physical stress. Upon inversion, the emulsion releases the polymer into water in a very short period of time when compared to the length of time required to dissolve a solid form of the polymer. This inversion technique is described in U.S. 3,624,019, Anderson, hereinafter incorporated by reference. As stated in the Anderson reference, the polymer-containing emulsions may be inverted by any number of means. The most convenient means resides in the use of a surfactant added to either the polymer-containing emulsion or the water into which it is to be placed. The placement of a surfactant into the water causes the emulsion to rapidly invert and release the polymer in the form of an aqueous solution. When this technique is used to invert the polymer-containing emulsion, the amount of surfactant present in the water may vary over a range of 0.01 to 50 percent based on the polymer. Good inversion often occurs within the range of 1.0 to 10 percent based on polymer.

The preferred surfactants utilized to cause the inversion of the water-in-oil emulsion of this invention when the emulsion is added to water are hydrophilic and are further characterized as being water soluble. Any hydrophilic type surfactant such as ethoxylated nonyl phenols, ethoxylated nonyl phenol formaldehyde resins, dioctyl esters of sodim succinate and octyl phenol polyethoxy ethanols, etc. can be used. Preferred surfactants are generally nonyl phenols which have been ethoxylated with between 9–15 moles of ethylene oxide. A more complete list of surfactants used to invert the emulsion are found in Anderson, U.S. Pat. No. 3,624,019 at columns 4 and 5.

EXAMPLE 1

| WATER-IN-OIL-EMULSIONS | |
|---|---|
| 4.5% | ethoxylated (5–6 moles) carboxy-4-hexyl-2-cyclohexene octanoic acid (castor oil); |
| 6.3% | tall oil; |
| 2.7% | triethanolamine; |
| 1.8% | EO/PO tall oil acid ester; |
| 9.0% | sodium petroleum sulfonate; |
| 2.7% | EO/PO polymer; |
| 18.0% | castor oil ethoxylate (25 moles); |
| 50.35% | D.I. water; |
| 4.5% | polyglycol, alkanol amine mixture; |
| 0.15% | triazine. |
| 100.00% | |

EXAMPLE 2

ANALOGOUS PREPARATION OF A WATER-IN-OIL EMULSION OF WATER SOLUBLE VINYL ADDITION POLYMERS

The water-in-oil emulsions of water-soluble vinyl addition polymers useful in this invention contain four basic components. These components are their weight percentages in the emulsions are listed below:

A. Water-soluble vinyl addition polymer:
1. Generally from 5–60%;
2. Preferably from 20–40%; and
3. Most preferably from 25–35%;

B. Water:
1. Generally from 20–90%;
2. Preferably from 20–70%; and
3. Most preferably from 30–55%;

C. Hydrophobic liquid:
1. Generally from 5–75%;
2. Preferably from 5–40%; and
3. Most preferably from 20–30%; and D. Water-in-oil emulsifying agent:
1. Generally from 0.1–21%;
2. Preferably from 1–15%;
3. Most preferably from 1.2–10%.

What is claimed is:

1. A micro-emulsion drawing and stamping extreme pressure lubricant composition for steel and aluminum which consists essentially of water and about 2 to 30 percent of 500–3,000 s.u.s. viscosity hydrocarbon oil, and as an emulsifier and stabilizer base is tall oil fatty acid, triethanolamine soap, petroleum sulfonate and nonionic emulsifier.

2. A lubricant composition according to claim 1 wherein the emulsion is a water-in-oil emulsion of about 4.5% of 1,450–3,000 s.u.s. viscosity hydrocarbon oil.

3. A lubricant composition according to claim 1 which excludes the use of chlorine in the lubricant.

4. A method of drawing and stamping steel and aluminum which comprises utilizing as an extreme pressure boundary lubricant the lubricant of claim 1.

5. A water in polymer micro-emulsion extreme pressure drawing and stamping lubricant for steels and aluminum which consists essentially of water and 2 to 30 percent of an oxidized polymer of vegetable oil consisting of ethylene oxide (EO), propylene oxide (PO) and ethylene propylene oxide (EO/PO) units of vegetable oil and an emulsifier and a stabilizer base.

6. A lubricant according to claim 5 wherein the emulsifier and stabilizer base components are tall oil fatty acid, triethanol amine soap, petroleum sulfonate and a non-ionic stabilizer constituting the micro-emulsion base.

7. A lubricant according to claim 6 wherein the vegetable oil is selected from at least one member of a group consisting of castor, corn, cottonseed, palm, peanut, soybean and olive.

8. A method of drawing and stamping steel and aluminum which consists essentially of utilizing as an extreme pressure lubricant the lubricant of claim 5.

9. A method of drawing and stamping steel and aluminum which consists essentially of utilizing as an extreme pressure lubricant the lubricant of claim 6.

10. A water-in-polymer micro-emulsion extreme pressure drawing and stamping lubricant which consists essentially of about:

4.5% ethoxylated (5–6 moles) carboxy-4-hexyl-2-cyclohexene octanoic acid (caster oil);
6.3% tall oil;
2.7% triethanolamine;
1.8% EO/PO tall oil acid ester;
9.0% sodium petroleum sulfonate;
2.7% EO/PO polymer;
18.0% caster oil ethoxylate (25 moles);
50.35% D.I. water;
4.5% polyglycol, alkanol amine mixture, and
0.15% triazine.

11. A water based lubricant for high pressure drawing and stamping of metals which comprises a phase invertible micro-emulsion containing:

I. a lubricant chosen from the group consisting of
(a) from 0–35 weight percent, based on total weight of the micro-emulsion, of a hydrocarbon oil having a viscosity ranging between about 500–3000 s.u.s., and
(b) from 0–35 weight percent, based on total weigth of the micro-emulsion, of a highly alkoxylated vegetable oil, and
(c) mixtures of (a) and (b); provided that the sum of (a) plus (b) ranges between about 10–35 weight percent of the micro-emulsion;

II. water ranging between about 25–75 weight percent of the micro-emulsion;

III. a sulfur, phosphorous and chlorine free high pressure lubricant ranging between about 3–7 weight percent of the micro-emulsion;

IV. a petroleum sulfonate, or salt thereof, ranging between about 5–15 weight percent of the micro-emulsion;

V. a $C_{12}$–$C_{24}$ fatty acid amine soap ranging between about 5–12 weight percent of the micro-emulsion;

VI. a non-ionic, alkoxylated coupling agent ranging between about 2–7 weight percent of the micro-emulsion;

VII. a low degree alkoxylated vegetable oil ranging between about 0–10.0 weight percent of the micro-emulsion;

which invertible micro-emulsio, after use as a high pressure lubricant, is easily water washed from equipment needed in the drawing and stamping of metals.

* * * * *